United States Patent [19]

Valiulis

[11] Patent Number: 4,976,058

[45] Date of Patent: Dec. 11, 1990

[54] ARM-TYPE LABEL HOLDER FOR DISPLAY HANGERS

[75] Inventor: Stanley C. Valiulis, Rockford, Ill.

[73] Assignee: Southern Imperial, Inc., Rockford, Ill.

[21] Appl. No.: 462,721

[22] Filed: Jan. 9, 1980

[51] Int. Cl.[5] ..... A47F 7/00; G09F 1/00

[52] U.S. Cl. ..... 40/657; 248/220.4; 211/59.1

[58] Field of Search ..... 40/657, 642, 124.4; 248/220.4, 221.1, 221.2; 211/54.1, 57.1, 59.1

[56] References Cited

U.S. PATENT DOCUMENTS

| | | | |
|---|---|---|---|
| 3,912,084 | 10/1975 | Valiulis | 248/220.4 |
| 4,463,510 | 8/1984 | Windish | 211/59.1 |
| 4,583,308 | 4/1986 | Taub | 40/642 |
| 4,646,454 | 3/1987 | Fast | 211/54.1 |
| 4,703,570 | 11/1987 | Fast | 40/657 |
| 4,715,135 | 12/1987 | Fast | 40/642 |
| 4,750,698 | 6/1988 | Barns | 211/59.1 |

OTHER PUBLICATIONS

T-PlasTech Brochure, Publication Date Unknown.

*Primary Examiner*—Gary L. Smith
*Assistant Examiner*—F. Saether
*Attorney, Agent, or Firm*—Leydig, Voit & Mayer

[57] ABSTRACT

A snap-on label holder includes an elongated arm, a plate for a label at the outer end of the arm, and a mounting bracket at the inner end of the arm. The mounting bracket includes multiple sets of notches which enable the holder to be used universally with all-wire display hangers, with two-piece display hangers and with loop-type display hangers.

5 Claims, 2 Drawing Sheets

ARM-TYPE LABEL HOLDER FOR DISPLAY HANGERS

BACKGROUND OF THE INVENTION

This invention relates generally to a merchandising accessory and, more particularly, to an arm-like device adapted to be snapped onto a display hanger for the purpose of holding a label having price and merchandise information.

Display hangers are widely used in connection with a perforated panel or "Pegboard" in retail establishments. One of the most common types of hanger is a so-called all-wire hanger having an elongated hanger arm and having a wire cross-piece welded to the inner end of the arm. The cross-piece is formed with horns adapted to extend through holes in the panel in order to attach the hanger to the panel.

Another popular hanger is a two-piece hanger of the type disclosed in Valiulis U.S. Pat. No. 3,912,084. That hanger has a wire hanger arm and a separate plastic mounting bracket, the bracket being formed with horns adapted to extend through holes in the panel.

A hanger which is gaining in popularity is a so-called loop hook. Such a hook is disclosed in commonly owned Valiulis U.S. application Ser. No. 185,885, filed Apr. 25, 1988 and comprises a pair of horizontally spaced arms joined integrally at their outer ends and defining a U-shaped configuration when viewed from above. The inner ends of the two arms are formed with horns which serve to attach the hanger to the panel.

In recent years, devices have been used with display hooks of the above types for the purpose of holding a tag or label containing product identification and price information. A relatively inexpensive device comprises a molded plastic strip which overlies the hanger arm. A flap on the outer end of the strip extends downwardly in front of the hanger arm and defines a surface to which a label or tag may be attached. A depending mounting tongue on the inner end of the strip is adapted to be snapped over the horns of the hanger in order to secure the device to the hanger. The strip is flexible and may be bowed upwardly to enable merchandise to be removed from the hanger arm. A device of this type is disclosed in Fast U.S. Pat. No. 4,525,944.

The aforementioned Valiulis '084 patent discloses another type of snap-on label holder while Valiulis U.S. Pat. No. 4,394,909 discloses a label holder which is adapted to be attached directly to the perforated panel.

A problem which exists involves the requirement of the retailer to keep on hand different types of label holders for different types of hangers. This requirement causes the retailer to carry a relatively large stock of label holders and encumbers the process of creating a merchandise display on a perforated panel.

SUMMARY OF THE INVENTION

The general aim of the present invention is to provide a new and improved arm-like label holder which may be snapped universally onto all-wire hangers, two-piece hangers and loop-type hangers.

Another object of the invention is to provide a label holder whose vertical position relative to the hanger arm of an all-wire hanger or a two-piece hanger may be easily adjusted so as to enable the hanger to accommodate different product packaging.

In a more detailed sense, the invention resides in an arm-like label holder having a mounting bracket which is formed with multiple sets of notches for accommodating the horns of different types of hangers and for enabling selective vertical adjustment of the holder relative to the hanger.

These and other objects and advantages of the invention will become more apparent from the following detailed description when taken in conjunction with the accompanying drawings.

DETAILED DESCRIPTION OF THE PREFERRED EMBODIMENT

Figure 1:
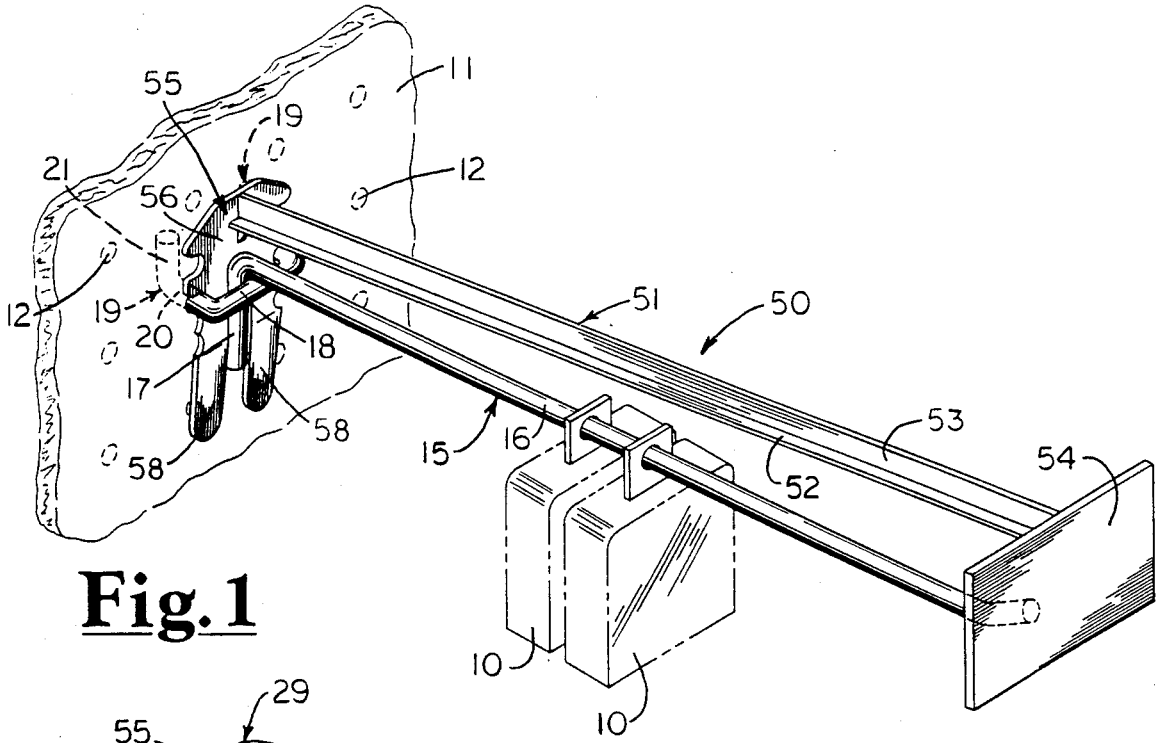
FIG. 1 is a perspective view showing a new and improved arm-like, label holder incorporating the unique features of the present invention attached to an all-wire hanger.

For purposes of illustration, the invention has been shown in the drawings in conjunction with hangers for supporting articles 10 from a perforated panel or "Pegboard" 11 of the type formed with a series of vertically spaced and horizontally extending rows of holes 12. In this instance, the articles have been illustrated as being bags within which merchandise is contained. The upper end portion of each bag is formed with a hole to enable the bag to be hung from the hanger.

Three different types of hangers have been illustrated. The first hanger 15 is shown in FIG. 1 and in phantom lines in FIGS. 5 and 6 and is an all-wire hanger. Such a hanger includes an elongated hanger arm 16 made of round wire and having an integral depending finger 17 at its inner end. A round wire mounting piece includes a horizontal section 18 located beneath the inner end of the arm and welded to the outer side of the finger. Horns 19 are formed integrally with each end of the cross-piece 18. Each horn includes a horizontal portion 20 projecting inwardly through a hole 12 in the panel 11 and further includes a vertical portion 21 which hooks behind the inner side of the panel.

The hanger 15 is attached to the panel 11 by locating the hanger in a vertical position with the hanger arm 16 pointing upwardly and with the portions 21 of the horns 19 pointing toward and aligned with a pair of horizontally spaced holes 12 in the panel. The hanger is first moved inwardly to cause the horn portions 21 to enter the holes 12 and then is swung downwardly and pushed inwardly to cause the horn portions 21 to hook behind the panel and to cause the horn portions 20 to move into the holes. When the hanger is in its installed position, the finger 17 engages the outer face of the panel 11 to limit downward swinging of the hanger.

Figure 2:
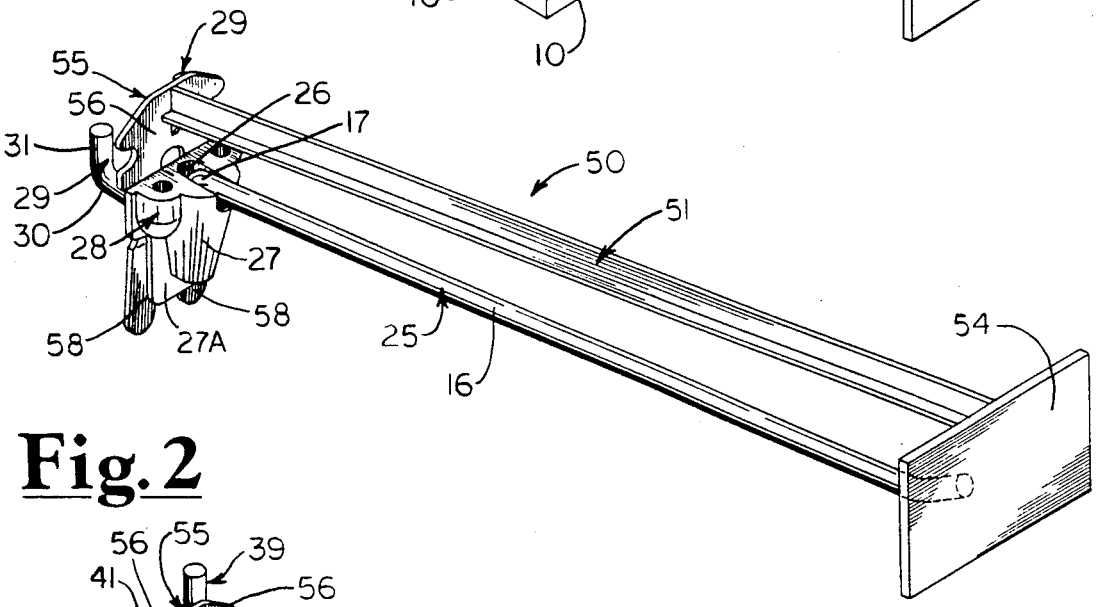
FIG. 2 is a view generally similar to FIG. 1 but shows the holder attached to a two-piece hanger.

The second type of hanger which has been illustrated is a two-piece hanger 25 of the type shown in FIG. 2. This hanger also includes a wire hanger arm 16 with a depending finger 17 formed integrally with its inner end. The finger is adapted to be telescoped removably into a vertical hole 26 formed in a boss 27 which constitutes part of a plastic bracket 28. The bracket includes an upright plate 27A located at the inner side of the boss and formed with a pair of horns 29 each having a horizontal portion 30 and a vertical portion 31. The bracket 28 is installed on the panel 11 by positioning and turning the bracket much in the same manner as the hanger 15. After the bracket has been installed, the hanger arm 16 is attached to the bracket by inserting the finger 17 into the hole 26 in the boss 27. Reference may be made to Valiulis U.S. Pat. No. 3,912,084 for a more detailed disclosure of a two-piece hanger similar to that shown in FIG. 2.

Figure 3:
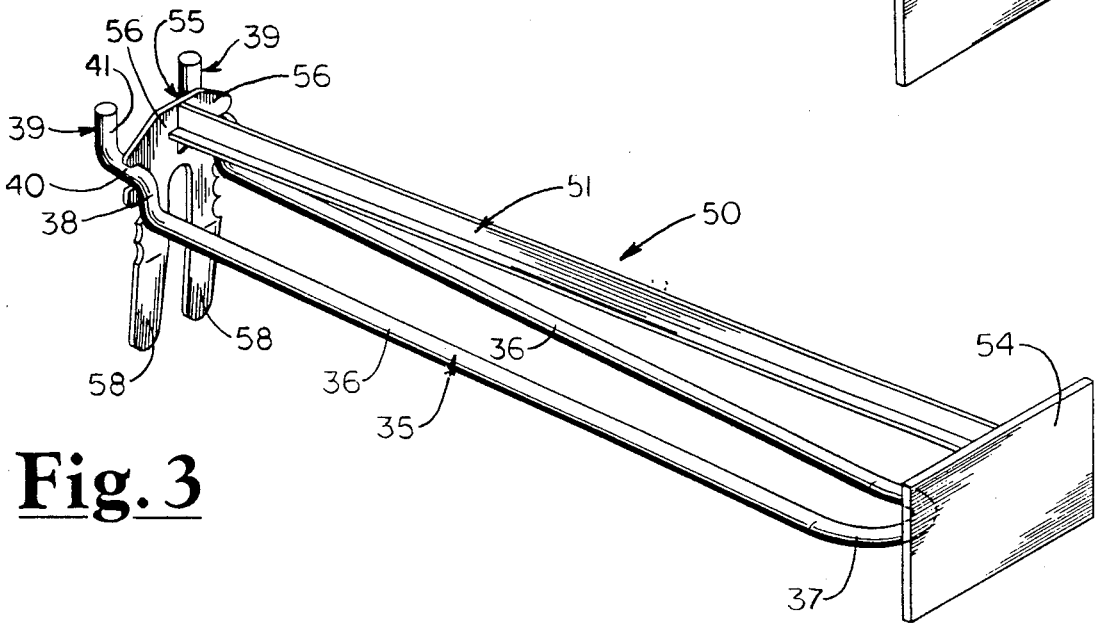
FIG. 3 also is a perspective view generally similar to FIG. 1 but shows the holder attached to a loop-type hanger.

FIG. 3 shows the third type of hanger 35, this hanger being a so-called loop hook. The hanger 35 is made of round wire which is bent so as to form two laterally spaced and generally horizontally extending hanger arm sections 36 adapted to extend outwardly from the panel 11 and adapted to extend through elongated slots formed in the upper ends of the bags 10. The outer end portions of the hanger arm sections 36 are bent laterally and reversely toward one another and define a convexly rounded tip portion 37 at the outer end of the hanger.

Horns 39 are formed integrally with the inner ends of the arm sections 36 of the hanger 35. Herein, each horn includes a first vertical portion 38 at the inner end of the arm section 36, a horizontally extending portion 40, and a second vertical portion 41 at the inner end of the horizontal portion. The hanger 35 is installed on the panel 11 in the same manner as the all-wire hanger 15. When the hanger 35 is swung downwardly, the vertical portions 38 of the horns 39 engage the forward side of the panel to limit downward pivoting of the hanger.

Hangers 15, 25 and 35 of the foregoing type have been used for many years. In more recent years, it has become conventional to use a label holder in conjunction with a merchandise hanger. The holder displays a printed label which sets forth the price, stock number, name and other information concerning the merchandise 10 supported by the hanger.

The present invention contemplates the provision of a new and improved snap-on label holder 50 which may be used universally with all three hangers 15, 25 and 35. Moreover, when used with the hanger 15 or the hanger 25, the holder may be selectively adjusted to different heights so as to enable the holder to be positioned in accordance with the nature of the merchandise 10.

Figure 4:
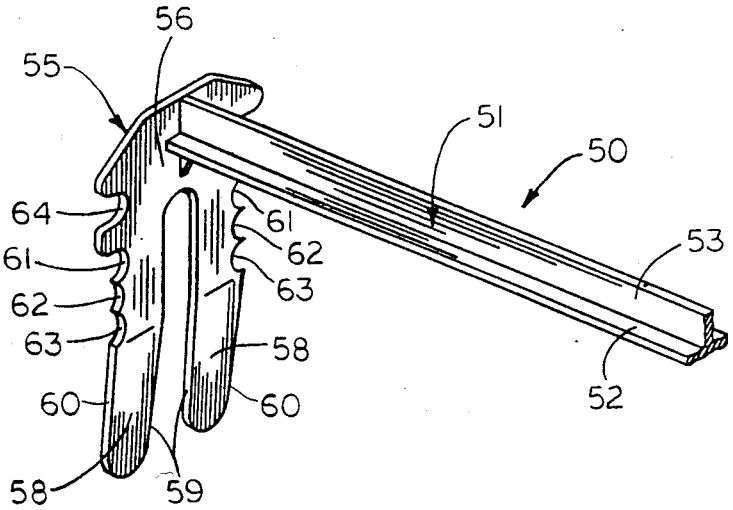
FIG. 4 is a fragmentary perspective view of the holder.

More specifically, the label holder 50 includes an elongated and relatively rigid arm 51 which is molded of plastic. In this particular instance, the arm is of an inverted T-shaped cross-section and includes a lower plate 52 and an upstanding web 53 (FIGS. 1 and 4).

Formed integrally with the outer end of the arm 51 is an upright plate 54 whose outer surface defines a support to which a label may be secured. The plate 54 is joined to the arm 51 near the upper end portion of the plate and thus the plate extends downwardly from the arm.

In carrying out the invention, a bracket 55 is molded integrally with the inner end of the arm 51 and is uniquely configured to enable the holder 50 to be snapped onto all three types of hangers 15, 25 and 35. The upper end portion of the bracket is defined by an upright plate 56 (FIG. 4) to which the arm 51 is joined, the included angle between the lower side of the arm and the outer side of the plate being slightly more than 90 degrees. Molded integrally with and depending from the plate are two laterally spaced legs 58. The legs include opposing inboard edges 59 and oppositely facing outboard edges 60 (FIG. 4).

Three sets of vertically spaced notches 61, 62 and 63 (FIGS. 4 and 5) are formed in the outboard edges 60 of the legs 58. In addition, another set of notches 64 is formed in the outboard edges of the plate 56 just above the upper ends of the legs. While the bottoms of all of the notches are on the same radius and are spaced equidistantly from the vertical centerline of the bracket 55, the width of the plate 56 is somewhat greater than the combined width of the legs 58 and thus the upper side walls of the notches 61 and the upper and lower side walls of the notches 64 are of greater lateral extent than the lower side walls of the notches 61 and the side walls of the notches 62 and 63.

Figure 5:
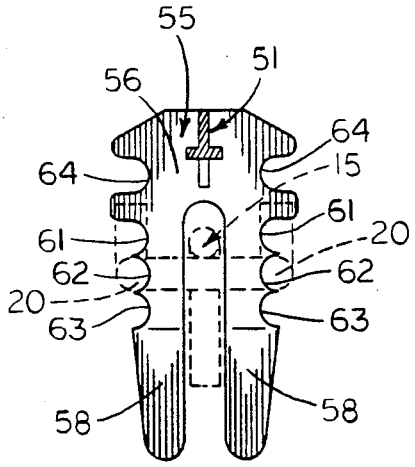
FIG. 5 is a front elevational view of the mounting bracket of the holder shown in FIG. 4, the arm of the holder being broken away and shown in section.
Figure 6:
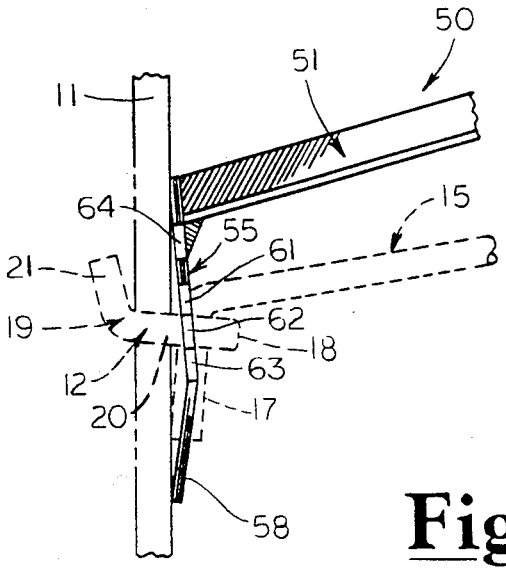
FIG. 6 is a side elevational view of the holder shown in FIG. 4.

With the foregoing arrangement, the label holder 50 may be snapped onto the all-wire hanger 15 simply by inserting the legs 58 of the bracket 55 between the panel 11 and the cross-piece 18 and by pushing downwardly on the bracket to cause the legs to move downwardly between the horns 19 and to straddle the finger 17. As the legs move downwardly, they are cammed inwardly by the horizontal portions 20 of the horns 19. The resiliency of the plastic tends to return the legs to an outwardly spread position and, as a result, one of the sets 61, 62, or 63 of notches snaps over and embraces the horizontal portions 20 of the horns to secure the holder 50 to the hanger 15. In FIG. 1, the horizontal portions 20 of the horns 19 are shown as being seated in the notches 61 and thus the holder 50 is installed with its arm 51 relatively close to the arm 16 of the hanger 15. If the merchandise 10 is such as to require more clearance between the arms 16 and 51, the bracket 55 may be positioned such that the horizontal portions 20 of the horns 19 are received in the notches 62 as shown in FIGS. 5 and 6. If even greater clearance is required, the notches 63 may be employed.

The holder 50 is used with the two-piece hanger 25 of FIG. 2 in essentially the same manner. When the holder is installed, the horizontal portions 30 of the horns 29 of the bracket 28 are received in one of the three sets of notches 61, 62 or 63, the legs 58 being sandwiched between the panel 11 and the plate 27A of the bracket 28.

When the holder 50 is used with the loop hanger 35 of FIG. 3, the horizontal portions 40 of the horns 39 are received in the notches 64 in the plate 56. Being at a higher level, the notches 64 compensate for the vertical portions 38 of the horns 39 of the hanger 35 and enable the arm 51 of the holder 50 to be positioned in close proximity to the arm sections 36 of the hanger 35. The holder may be installed on the hanger 35 by positioning the bracket 55 at an angle to the panel 11 and then by turning the bracket about a vertical axis to cause the notches 64 to move into embracing relation with the horizontal portions 40 of the horns 39.

Preferably, each leg 58 of the bracket 55 includes an upper portion and a lower portion (see FIG. 6) which are angled such that the lower portion slants inwardly upon progressing downwardly. As a result, the lower portions of the legs 18 are deflected outwardly by the panel 11 when the holder 50 is installed. Because of such deflection, the bracket 55 is biased outwardly into engagement with the hanger to create a frictional force which helps retain the holder 50 in place. The flexibility of the legs also enables the outer end portion of the arm 51 to be flexed upwardly when merchandise is placed on or removed from the hanger.

From the foregoing, it will be apparent that the present invention brings to the art a new and improved snap-on label holder 50 which may be used universally with three different types of hangers 15, 25 and 35. As a result, the holder eliminates the need for providing different types of holders for different types of hangers and simplifies merchandising requirements.

I claim:

1. A merchandising accessory for universal use with different types of display hangers each having a pair of laterally spaced and generally horizontally extending horns adapted to project through holes in a perforated display panel, said accessory comprising an elongated arm adapted to extend outwardly and generally horizontally from said panel, means on the outer end of said arm for displaying merchandise indicia, and a bracket on the inner end of said arm for attaching said arm to a hanger, said bracket comprising an upright plate, a pair of laterally spaced legs formed integrally with and extending downwardly from the lower end of said plate, said legs having opposing inboard edges and having oppositely facing outboard edges, a first set of notches formed in the outboard edges of said legs for receiving the horns of a hanger of a first type, and a second set of notches formed in the outboard edges of said plate above the notches of said first set for alternately receiving the horns of a hanger of a second and different type.

2. A merchandising accessory as defined in claim 1 further including a third set of notches formed in the outboard edges of said legs below the notches of said first set for alternately receiving the horns of a hanger of said first type, said first set of notches and said third set of notches enabling said accessory to be selectively attached to a hanger of said first type at different elevations.

3. A merchandising accessory as defined in claim 1 in which said legs are made of resiliently yieldable material and include upper sections and lower sections, the lower section of each leg being inclined relative to the upper section thereof and sloping inwardly away from the upper section upon progressing downwardly.

4. A merchandising accessory as defined in claim 1 in which the outer face of said plate is inclined at an obtuse included angle relative to the lower side of said arm.

5. A one-piece merchandising accessory for universal use with different types of hangers each having a pair of laterally spaced and generally horizontally extending horns adapted to project through holes in a perforated panel, said accessory comprising an elongated arm made of plastic and adapted to extend outwardly and generally horizontally from said panel, means molded integrally with the outer end of said arm for displaying merchandise indicia, and a bracket on the inner end of said arm for attaching said arm to a hanger, said bracket comprising an upright plate molded integrally with the inner end of said arm, a pair of laterally spaced legs molded integrally with and extending downwardly from the lower end of said plate, said legs having opposing inboard edges and having oppositely facing outboard edges, a first set of notches formed in the outboard edges of said legs for receiving the horns of a hanger of a first type, and a second set of notches formed in the outboard edges of said plate above the notches of said first set and above the upper ends of said legs for alternately receiving the horns of a hanger of a second and different type.

* * * * *